United States Patent [19]

Yamamoto

[11] Patent Number: 4,908,669

[45] Date of Patent: Mar. 13, 1990

[54] TONER IMAGE TREATMENT DEVICE FOR USE IN ELECTROSTATIC COPYING MACHINES

[75] Inventor: Masaaki Yamamoto, Osaka, Japan

[73] Assignee: Minolta Camera Kabushiki Kaisha, Osaka, Japan

[21] Appl. No.: 258,859

[22] Filed: Oct. 17, 1988

[30] Foreign Application Priority Data

Oct. 21, 1987 [JP] Japan ..... 62-266868

[51] Int. Cl.[4] ..... G03G 15/20; G03G 8/00

[52] U.S. Cl. ..... 355/282; 118/271; 430/97

[58] Field of Search ..... 355/282, 290, 293, 294, 355/278, 309; 118/46, 60, 101, 202, 261, 271; 430/97, 99, 124; 427/428, 429

[56] References Cited

U.S. PATENT DOCUMENTS

| | | | |
|---|---|---|---|
| 3,934,256 | 1/1976 | Isonaka et al. | 355/309 X |
| 4,063,530 | 12/1977 | Thehu | 118/202 X |
| 4,770,909 | 9/1988 | McIntyre | 427/428 |

FOREIGN PATENT DOCUMENTS

| | | |
|---|---|---|
| 59-184382 | 10/1984 | Japan . |
| 60-135974 | 7/1985 | Japan . |

*Primary Examiner*—Joan H. Pendegrass

*Attorney, Agent, or Firm*—Wenderoth, Lind & Ponack

[57] ABSTRACT

A toner image treatment device smoothing an irregular surface of a fixed toner image with coating a transparent auxiliary material by a coating roller. The coating roller has a layer of porous elastic material being impregnated with a transparent resin which is a solid at room temperature but is a liquid at a high temperature, and a heater provided inside the porous elastic material for melting the transparent resin.

15 Claims, 2 Drawing Sheets

TONER IMAGE TREATMENT DEVICE FOR USE IN ELECTROSTATIC COPYING MACHINES

BACKGROUND OF THE INVENTION

1. Field of the Invention

The present invention relates to a device for use in copying machines and the like for treating toner images to improve the quality of the images.

2. Description of the Prior Art

As already known, electrophotographic copying machines are adapted to form a toner image on a copy sheet by an electrophotographic process and thereafter fix the toner image to the copy sheet by fusing with heat fixing means. The fixed toner image has surface irregularities, which nevertheless produce no adverse effect insofar as the toner used is black as is usually the case. However, with various color toners introduced into use recently, such irregularities pose a problem. The color toner, when used, fails to produce distinct images since light is scattered by the surface irregularities of the toner image. Especially when a color toner image formed on a transparent sheet is projected by an overhead projector (hereinafter referred to as "OHP"), the light from the light source of the OHP is scattered considerably by the surface irregularities of the color toner image, with the result that the color of the projected image appears darker than the true color of the original. Accordingly, it has been proposed to cover the irregular surface of the toner image with a transparent auxiliary material to smooth the surface so that the original color can be reproduced as desired for use with the OHP and the like (Unexamined Japanese Patent Publication No. SHO 60-135974).

Unexamined Japanese Patent Publication No. SHO 59184382 proposes a coating device for applying a transparent resin to the fixed toner images on copy sheets for OHPs, and a dryer disposed downstream from the device for drying the transparent resin coating. However, the coating device and the dryer needed render the machine large-sized and complex.

SUMMARY OF THE INVENTION

Accordingly, the main object of the present invention is to provide an improved device for giving distinct toner images by remedying the impaired appearance of the color of the toner image due to the surface irregularities thereof.

Another object of the invention is to provide a compact device for coating toner images with a transparent resin to eliminate the surface irregularities of the image.

These and other objects are attained by a toner image treatment device disposed downstream from a fixing device and comprising a porous roller, the roller having a heat source in its interior and being impregnated with a transparent resin, the resin being a solid at room temperature, a liquid at a high temperature and quick-drying and having a melting point lower than the fixing temperature of the fixing device.

BRIEF DESCRIPTION OF THE DRAWINGS

These and other objects or features of the present invention will become apparent from the following description of a preferred embodiment thereof taken in conjunction with the accompanying drawings, in which.

In the following description, like parts are designated by like reference numbers throughout the several drawings.

DESCRIPTION OF THE PREFERRED EMBODIMENT

An embodiment of the invention will be described below in detail with reference to the drawings.

Figure 1:
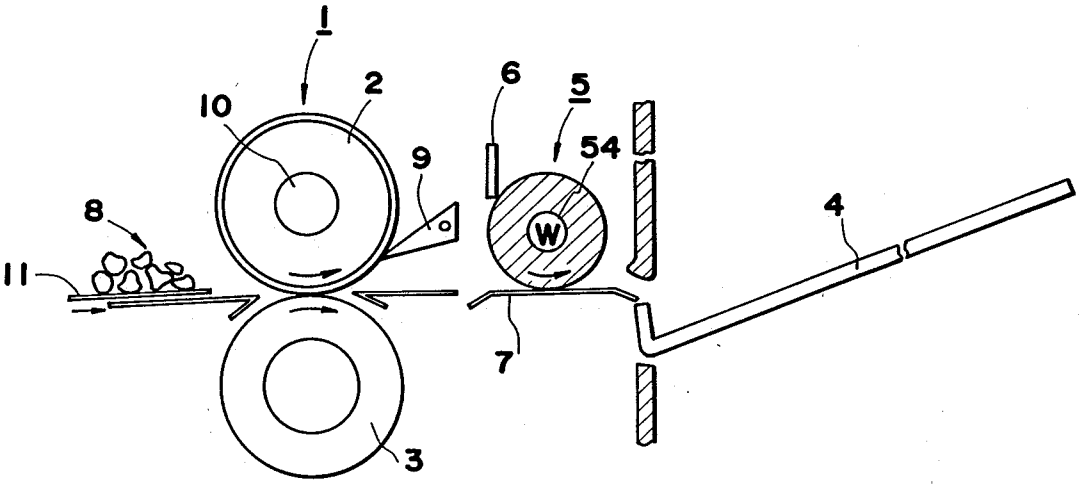
FIG. 1 is a sectional view of a heat fixing device and a toner image treatment device.
Figure 2:
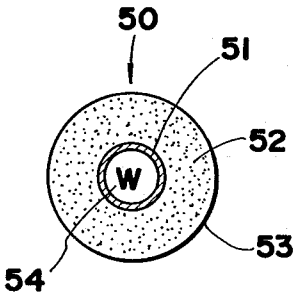
FIG. 2 is a sectional view of a coating roller.

FIG. 1 is a fragmentary sectional view of a conventional copying machine including a toner image treatment device 5 embodying the invention.

The toner image treatment device 5 is disposed downstream from a fixing device 1 with respect to the direction of transport of copy paper 11. The fixing device 1 comprises a fixing roller 2 and a pressure roller 3. An unfixed toner image formed on the copy paper 11 by unillustrated known exposure, developing and transfer units is first fixed to the paper 11 by the fixing device 1, then treated by the treatment device 5 and thereafter delivered onto a discharge tray 4.

The construction of the toner image treatment device 5 will be described next.

The device 5 comprises a porous elastic coating roller 50 for applying a transparent resin to the surface of the copy paper 11, a plate 6 for regulating the amount of resin to be applied to the image and a pressure plate 7 for holding the paper in pressing contact with the roller 50. The coating roller 50 comprises a metal core 51 and a layer 53 of porous elastic material provided around the metal core 51 for holding therein the transparent resin which is a solid at room temperature but is a liquid at a high temperature. Silicone sponge is used as the porous elastic material in the present embodiment. The porous elastic material is impregnated with the transparent resin 52 to retain the resin. To melt the transparent resin 52 which is in a solid state at room temperature, a melting heater 54 is provided inside the metal core 51 of the coating roller 50. The regulating plate 6 serves to regulate the amount of transparent resin for covering the toner image on the surface of the copy paper. The amount of resin to be applied is adjustable by controlling the pressure under which the regulating plate 6 is pressed against the elastic surface of the coating roller 50. The thickness of the resin coating over the toner image must be such that the coating permits the passage of light from the light source of an OHP or the like and forms a smooth surface over the toner image for the satisfactory projection of the toner image by the OHP. With the present embodiment, the regulating plate 6 is controlled to give a coating thickness of 15 to 20 micrometers. The pressure plate 7 is biased toward the coating roller 50 by unillustrated means. Although an aluminum panel coated with Teflon is used as the pressure plate 7 in the present embodiment, the plate can be replaced by a roller or the like.

The toner for use in the present embodiment has the following composition.

| | | |
|---|---|---|
| Resin: | Styrene-acrylic copolymer (SBM-73, product of SANYO CHEMICAL INDUSTRIES, LTD.) | 95 wt. % |
| Charge control agent: | Styrene-amino-acrylic copolymer (Lunapale 912, product of ARAKAWA CHEMICAL INDUSTRIES, LTD.) | 2 wt. % |
| Coloring agent: | Magenta organic pigment (Poliogon Red K3580, product of BASF) | 3 wt. % |

Examples of useful transparent resins for giving a smooth surface to the toner image are those having a low melting point and low viscosity, such as polypropylene, polyethylene, montan wax, polyolefin wax and the like. With the present embodiment, polyethylene (HW-110P, product of MITSUI PETROCHEMICAL INDUSTRIES, LTD.) is used as the transparent resin 52. This polyethylene is 113° C. in melting point and 20 cp in melt viscosity (140° C.). The coating roller 50 is impregnated with the polyethylene which is melted in advance by being heated to 140° C. with the heater 54 within the roller. Since the unfixed toner is fixed by fusing at a temperature of 160° C., it is unlikely that the heater 54 will fuse the fixed toner again.

The unfixed toner image formed on copy paper for the OHP by a known copying process is fixed to the paper by fusing with the fixing device 1. The fixed toner image, which has surface irregularities, is thereafter coated with liquid polyethylene over the surface by the coating roller 50 heated to 140° C. by the melting heater 54 and drivingly rotated. When the paper is released from the coating roller 50, the polyethylene applied to the paper solidifies upon spontaneous cooling.

Figure 3:
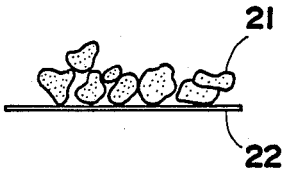
FIG. 3 is a diagram showing a toner image in an unfixed state.
Figure 4:
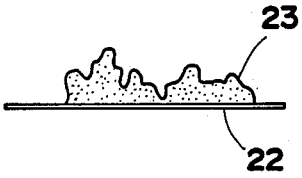
FIG. 4 is a diagram showing the toner image in a fixed state.
Figure 5:
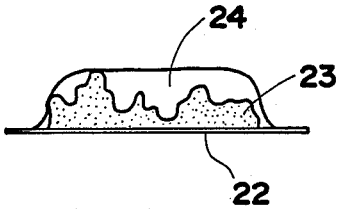
FIG. 5 is a diagram showing the fixed toner image as coated with a transparent resin.

FIGS. 3 to 5 show changes in the state of the toner image on the copy paper 22 thus treated in sequence. FIG. 3 shows the unfixed toner 21 before heat fixing. FIG. 4 shows the toner image 23 as fixed by heating and having surface irregularities. When the toner image is treated by the present embodiment, the indentations in the surface of the toner image are filled with polyethylene or like transparent resin 24, which forms a smooth surface as seen in FIG. 5. Consequently, a color image is obtained which can be satisfactorily projected by the OHP. Although paper for the OHP is used as the copy paper in the above description of the embodiment, plain paper or the like is similarly usable.

In the case of plain paper, the toner image can be improved in quality, while the paper can be coated with the transparent resin over the entire surface thereof, with the result that the toner image can be given higher durability for preservation.

The device of the present invention can be compactly incorporated into conventional copying machines between the fixing device and the discharge tray without the necessity of making the machine large-sized or complex.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A toner image treatment device for use in electrostatic copying machines with a fixing device which fixes a toner image onto a copy sheet, comprising:

a rotatable porous roller disposed downstream from the fixing device and being impregnated with a transparent resin which is a solid at room temperature and a liquid at a high temperature;

a heat source disposed in the interior of said porous roller to melt the transparent resin; and a member for bringing the copy sheet passed through the fixing device into contact with said porous rollers, whereby the toner image on the copy sheet is coated with the transparent resin.

2. A toner image treatment device of claim 1, further comprising:

regulating means for regulating an amount of the transparent resin to be applied to the toner image.

3. A toner image treatment device of claim 2, wherein said regulating means is of blade form.

4. A toner image treatment device of claim 1, wherein said transparent resin is one of polypropylene, polyethylene, montan wax and polyolefin wax.

5. A toner image treatment device of claim 1, wherein said transparent resin has a melting point lower than a temperature of the fixing device.

6. A toner image treatment device of claim 1, wherein said rotatable porous roller is heated to a temperature lower than a temperature of the fixing device by said heat source.

7. A toner image treatment device of claim 1, wherein said member is biased toward said rotatable porous roller.

8. A toner image treatment device of claim 1, wherein said member is of plate form.

9. An electrophotographic copying machine, comprising heat fixing means for fixing a toner image to a copy sheet by fusing with heat;

a discharge tray for receiving the copy sheet;

a rotatable porous roller disposed between said heat fixing means and said discharge tray and being impregnated with a transparent resin which is a solid at room temperature and a liquid at a high temperature;

a heat source disposed in the interior of said porous roller to melt the transparent resin;

a member for bringing the copy sheet passed through the fixing device into contact with said rotatable porous roller, and regulating means for regulating an amount of the transparent resin to be applied to the toner image, whereby the copy sheet is coated with the transparent resin and thereafter discharged on the discharge tray with the transparent resin solidified upon spontaneous cooling.

10. An electrophotographic copying machine of claim 9, wherein said regulating means is of blade form.

11. An electrophotographic copying machine of claim 9, wherein said transparent resin is one of polypropylene, polyethylene, montan wax and polyolefin wax.

12. An electrophotographic copying machine of claim 9, wherein said transparent resin has a melting point lower than a temperature of the fixing device.

13. An electrophotographic copying machine of claim 9, wherein said rotatable porous roller is heated to a temperature lower than a temperature of the fixing device by said heat source.

14. An electrophotographic copying machine of claim 9, wherein said member is biased toward said rotatable porous roller.

15. An electrophotographic copying machine of claim 9, wherein said member is of plate form.

* * * * *